United States Patent [19]

Schrader

[11] 4,075,864

[45] Feb. 28, 1978

[54] AIR CONDITIONING FAN CONTROL

[75] Inventor: Paul D. Schrader, Louisville, Ky.

[73] Assignee: General Electric Company, Louisville, Ky.

[21] Appl. No.: 792,450

[22] Filed: Apr. 29, 1977

[51] Int. Cl.[2] ..... F25D 17/06

[52] U.S. Cl. ..... 62/180; 62/202

[58] Field of Search ..... 62/202, 180, 186, 229

[56] References Cited

U.S. PATENT DOCUMENTS

| | | | |
|---|---|---|---|
| 2,038,578 | 4/1936 | Lamb | 237/2 R |
| 2,770,101 | 11/1956 | Smith | 62/180 |
| 3,063,249 | 11/1962 | Matthies | 62/140 |
| 3,474,639 | 10/1969 | Smith | 62/202 X |
| 3,621,669 | 11/1971 | Nichols et al. | 62/202 X |
| 3,635,044 | 1/1972 | Heth | 62/180 X |

*Primary Examiner*—William E. Wayner

*Attorney, Agent, or Firm*—Frank P. Giacalone; Francis H. Boos

[57] ABSTRACT

An air conditioner control circuit having a thermostat for automatically causing the air conditioner to be de-energized at predetermined low temperatures and including means for causing the fan motor to run periodically for some time period after the air conditioner has been de-energized to allow the air temperature to be better sampled by the thermostat. Means are also provided in the control circuit for allowing fan operation for a period of time after the air conditioner has been de-energized.

6 Claims, 3 Drawing Figures

AIR CONDITIONING FAN CONTROL

BACKGROUND OF THE INVENTION

1. Field of the Invention

This invention relates to air conditioner controls and more particularly to a control for regulating the operation of the air circulation means relative to the ambient temperature sensed by the thermostat control.

2. Description of the Prior Art

It has been common practice in the air conditioning industry to provide air conditioners with temperature controls that cycle or deenergize the compressor motor at selected low ambient temperature and permit constant fan operation during that period of time the compressor is de-energized. While this may have some desirable qualities in terms of preventing air stratification and more even temperatures it nevertheless is undesirable in that the constantly running fan motor consumes electrical energy.

One approach in conserving energy has been to cycle the fan with the compressor so that no electrical energy is expended when the compressor is de-energized at the selected low ambient temperature. While this does in fact result in the saving of electrical energy, it results in the undesirable stratification of air and uneven temperature between the ambient of the air being conditioned and that sensed by the thermostat.

U.S. Pat. No. 3,635,044-Heth discloses a circuit having a thermostat for automatically causing the air conditioner to be de-energized at predetermined low temperatures and including a timing device that causes the room air to be periodically delivered to the thermostat of the air conditioner. U.S. Pat. No. 3,621,669 discloses still another circuit for causing intermittent operation of the fan when the temperature sensed by the thermostat is below the temperature at which the thermostat causes continuous operation of the fan, thereby bringing room air into adjacency with the thermostat so as to correlate the temperature sensed by the thermostat with the room air temperature.

SUMMARY OF THE INVENTION

The present invention relates generally to an air conditioner including a refrigerant system, an air circulating fan, a thermal switching means for sensing the condition of the air to be conditioned and for terminating operation of the air circulating fan and refrigerant system at a preselected low ambient air temperature, and a control for controlling the operation of the fan when the thermostat terminates operation of said refrigerant system. The control includes a fan control switch having a first position for energizing the fan when the ambient temperature is above the selected low temperature and a second position for energizing the fan when the ambient temperature is at or below the selected low temperature.

The control further includes first actuating means associated with the switch which is operable when the ambient is above the selected low temperature for causing the switch to move to the second position for operating the fan through the fan control switch so that the fan continues to operate for a predetermined time subsequent to each stoppage of the refrigeration system. The control also includes a second actuating means associated with the switch which is operable for actuating the switch between its first and second position for periodically operating the fan when the ambient temperature is below the selected temperature.

DESCRIPTION OF THE PREFERRED EMBODIMENT

Figure 1:
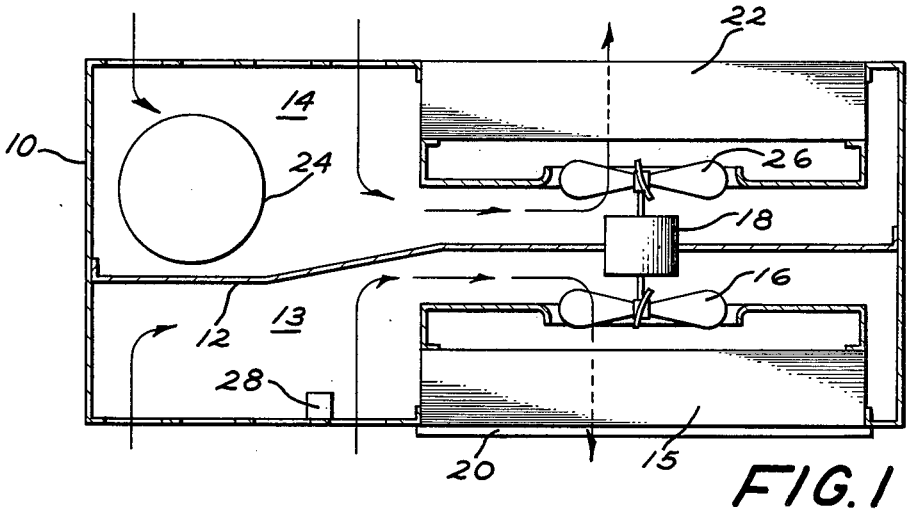
FIG. 1 is a schematic plan view of an air conditioner employed in the present embodiment.

Referring to FIG. 1 of the drawing, there is shown one embodiment of the present invention in the form of an air conditioning unit of the type generally known as a self-contained unit which is adapted to be mounted through a wall of an enclosure to be cooled. The unit includes a casing 10 which is divided by means of a barrier 12 into an indoor compartment 13 and an outdoor compartment 14. A refrigeration system housed with the casing 1G includes an evaporator 15 contained within the indoor compartment 13. Room air to be conditioned or cooled is drawn into the indoor compartment 13 by means of a fan 16 driven by a suitable electric motor 18. The air entering compartment 13 after passing over the evaporator 15 is discharged back into the room through a grill 20.

The outdoor compartment 14 includes the condenser 22 and compressor 24 of the refrigeration system. Outdoor air is moved through compartment 14 and condenser 22 by a fan 26 which, as shown in the present embodiment, may be driven by the motor 18 which drives fan 16.

Figure 2:
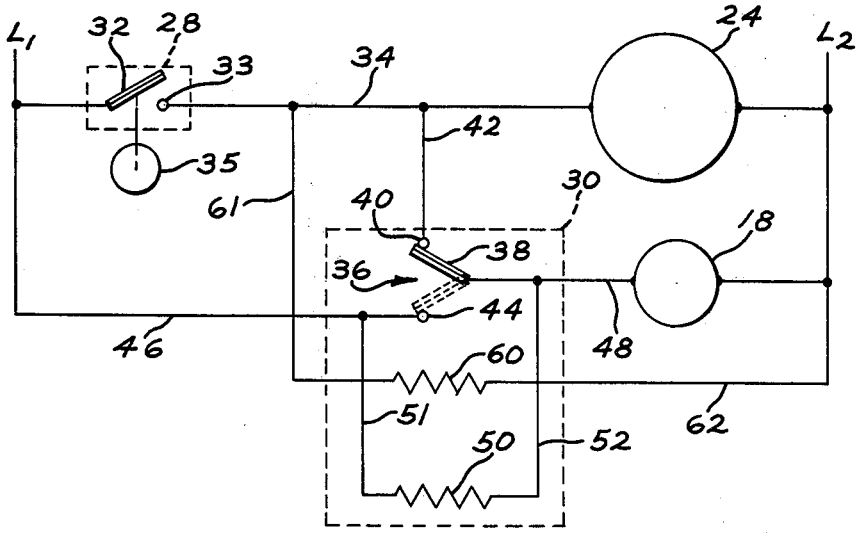
FIG. 2 is a schematic wiring diagram of a control circuit of the present invention.

According to the present invention there is provided a control system for the air conditioner including refrigeration system compressor 24 and more particularly an improved control for the operation of fan motor 18. The present control system as shown in FIG. 2 includes a thermostat 28 arranged so as to sense the temperature of the room air entering the air conditioner and, accordingly, may be mounted in the air flow path generally as shown in FIG. 1. It should be noted however that the exact location of the thermostat and the type used may vary from unit to unit and the showing in FIGS. 1 and 2 is merely representative of a typical thermostat that may be used in carrying out the present invention.

As shown in FIG. 2, the control circuit includes the thermostat 28 and a fan control means 30. The compressor 24 is energized from supply line L1 through movable thermostat switch 32, its contact 33 and line 34. Generally, when the room ambient air sensed by thermostat 28 reaches a predetermined low temperature, it causes thermal switch 32 to open and accordingly de-energizes the compressor 24. The predetermined low temperature may be selected, and accordingly a knob 35 or means may be provided for adjusting the thermal switch 32 of thermostat 28 so that it will open at a desired low temperature to de-energize the refrigeration system compressor 24.

The present invention provides means for controlling operation of the fan motor 18 independent of compressor operation. The fan control means 30 includes a switch 36 having a thermal snap-action switching member 38 that moves between a switch contact 40 connected by line 42 to line 34 and a contact 44 connected by line 46 to line L1. The fan motor 18 is connected between thermal switch member 38 and supply line L2 by line 48 so that a circuit is completed from line L1, switch member 32, line 34, contact 40, member 38, through fan motor 18 to line L2. Accordingly, when the air sensed by thermostat 28 is above the selected low temperature and switch 32 is in its closed position on contact 33 calling for cooling, a circuit is completed to both the compressor 24 through line 34, and the fan motor 18 through contact 40 and its switch member 38 to line 48. It should be noted at this time that the position shown in FIG. 2 of switch 36 with member 38 in engagement with contact 40 is the normal or ambient position.

With the switch 36 in the position shown in FIG. 2, the fan motor 18 would be de-energized with the compressor 24 whenever the selected low temperature sensed by the thermostat 28 causes switch member 32 to move to its open position away from contact 33 as shown.

Means are provided as part of fan control 30 that is effective in causing fan motor 18 to be energized through contact 44 of switch 36 when the ambient temperature sensed by thermostat 28 is at or below the selected low temperature and switch member 32 is in its open position shown.

More specifically, the fan control 30 includes means that causes periodic energization of fan motor 18. This intermittent operation of fan motor 18 for a selected period of time allows the room air temperature to be better sampled by the thermostat 28 while the refrigeration system compressor 24 is de-energized.

To this end a heater 50 is arranged in heat exchange relationship with the thermal or bimetal portion 38 of switch 36. The heater 50 is connected between line 46 and 48 by line 51 and 52 respectively. The heater 50 is arranged across switch contact 44 and member 38 and in parallel with the thermostat switch 32 and switch 36. Accordingly, the heater 50 is shunted and inoperative whenever the thermostat switch 32 is closed and switch member 38 is in engagement with contact 40 causing operation of both compressor 25 and fan 18.

Figure 3:
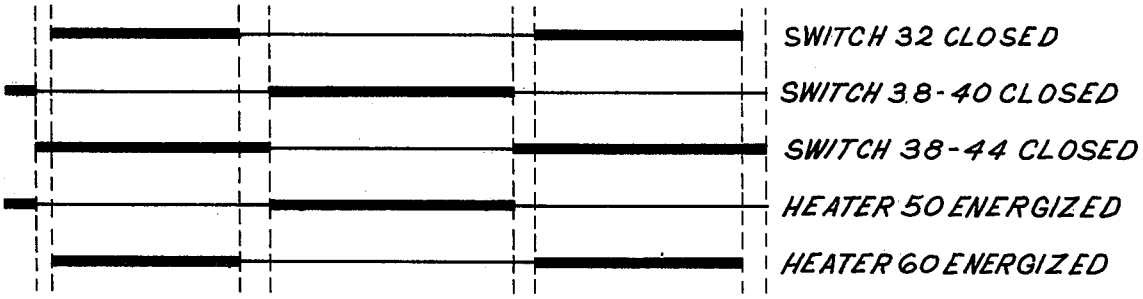
FIG. 3 is a schematic chart showing a sequence of operation.

In operation, when the thermostat 28 senses the selected low temperature, switch 32 opens removing the shunt across heater 50. Heater 50 is then energized through lines 46, 51, 52, fan motor 18, causing the fan motor 18 to be energized to supply room air to the thermostat 28. Energization of heater 50 causes the thermal switch member 38 to snap from its normal position on contact 40 as shown in FIG. 2 to the dotted line position in engagement with contact 44. While this completes the circuit through the fan motor 18, heater 50 is now shunted across switch 36 and de-energized. As the de-energized heater 50 starts to cool down, the thermal switch member 38 after a period of time snaps back to its position on contact 40, once again de-energizing the fan motor 18 as long as the thermostat switch 32 is open. The above described fan motor 18 cycling or periodic operation continues with the thermostat 28 sampling the room air until the thermostat switch 32 closes at the selected low temperature, at which time cooling operation is effective with normal operation of the compressor 24 and fan motor 18 being initiated as described hereinabove. The length of fan motor run time may be conveniently determined by the heater location relative to switching member 38, heater output, responsiveness of the thermal switch 38 and the mass designed into the contact 30. Representative times and switch positions relative to fan cycling are shown in FIG. 3.

When the compressor 24 is deenergized, the shutting down of the refrigeration system may result in undesirable noises as the refrigerant in the system stabilizes. It has been determined that operation of fan motor 18 and the resultant air flow generated by fan 16 after the compressor 24 is de-energized is beneficial in masking some of the undesirable noises.

As mentioned hereinbefore, the control 30 includes means for causing the fan motor 18 to remain energized for a predetermined period of time after compressor 24 is de-energized. To this end, a heater 60 is arranged in heat exchange relationship with the thermal or bimetal portion 38 of switch 36. The heater 60 is connected between line 34 and line L2 by line 61 and 62 respectively. Accordingly, heater 60 is energized when the thermostat contact 32 is in its closed position. In operation, when the thermostat 28 calls for cooling and switch 32 closes, the compressor 24 is energized through line 34 with fan motor 18 being energized through contact 40 of control switch 36. However, at the same time, with switch 32 closed a circuit as explained hereinabove is completed through heater 60 on lines 61 and 62. The energization of heater 60 causes the thermal switch member 38 to snap from its normal position on contact 40 as shown in FIG. 2 to the dotted line position against contact 44. This then completes a circuit through the fan motor 18 from line L1 through line 46, contact 44, line 48 to L2 so that fan operation continues as long as switch 32 is closed. Accordingly, fan motor 18 is now energized through switch 36 due to the action of heater 60 on switch element 38. The fan motor in this mode is operating independent of the position of thermostat switch 32.

When switch 32 senses the selected low temperature and opens, the circuit to heater 60 is opened and it is de-energized; however, the fan motor continues to operate through contact 44 until such time as the heat generated from the now de-energized heater 60 is dissipated to cause the thermal switching element 38 to cool and snap over to its normal position on contact 40 and de-energize the fan motor 18 in the event thermostat switch 32 is still in its open position. The amount of time the fan motor runs after thermostat switch 32 opens and the heater 60 is de-energized is controlled by the size of heater 60, its location relative to the member 38 and the thermal mass of the control 30. The representative time lag of fan motor operation is not critical and a run time of approximately one minute has been determined to be adequate as indicated in FIG. 3.

The foregoing is a description of the preferred embodiment of the invention and variations may be made thereto without departing from the true spirit of the invention, as defined in the appended claims.

What is claimed is:

1. In an air conditioner including means for conditioning air, air circulation means for circulating ambient air in association with said conditioning means, temperature responsive means for sensing the condition of air to be conditioned for terminating operation of said air circulating means and said air conditioning means at a preselected low ambient air temperature, control means for controlling the operation of said air circulating means when said temperature responsive means senses temperatures above said preselected temperature, comprising:

said control including switch means having a first position for energizing said air circulating means when the temperature sensed by said temperature responsive means is above said preselected low temperature and a second position for energizing said air circulating means when said temperature responsive means senses said preselected low temperature;

a first actuating means associated with said switch means being operable when the temperature sensed by said temperature responsive means is above said preselected temperature for causing said switch to move to said second position to operate said air circulating means through said control means so that said air circulating means will continue to operate for a predetermined time subsequent to each stoppage of said air condition means after said temperature responsive means senses said preselected low temperature;

a second actuating means associated with said switch means being operable for actuating said switch means between said first and second position for periodically operating said air circulating means to sample the ambient air by bringing ambient air periodically to said temperature responsive means when the temperature sensed by said temperature responsive means is below said preselected low ambient temperature.

2. The combination of claim 1 wherein said control switch means includes a thermal switching member.

3. The combination of claim 2 wherein said second actuating means is an electrically energized resistance heater and in which energy is supplied to said heater only when said fan is de-energized.

4. The combination of claim 3 wherein said first actuating means is an electrically energized resistance heater and in which energy is supplied to said heater only when said compressor and air circulating means are energized.

5. The combination of claim 4 wherein said second heater is connected across said thermal switch member and said thermostat means so as to be energized only when said thermal switch is in its first position and said thermostat has de-energized said air conditioning means.

6. The combination of claim 5 wherein said first heater is connected in series with said thermostat and in parallel with said air conditioning means and air circulating means when said thermal switch is in said first position so as to be energized only when said compressor and air circulating means are energized.

* * * * *